United States Patent [19]

Kern

[11] Patent Number: 4,745,967

[45] Date of Patent: May 24, 1988

[54] HEAT EXCHANGER, PARTICULARLY A REFRIGERANT EVAPORATOR

[75] Inventor: Josef Kern, Alfdorf, Fed. Rep. of Germany

[73] Assignee: Süddeutsche Kühlerfabrik Julius Fr. Behr GmbH & Co. KG, Stuttgart, Fed. Rep. of Germany

[21] Appl. No.: 823,008

[22] Filed: Jan. 27, 1986

[30] Foreign Application Priority Data

Jan. 26, 1985 [DE] Fed. Rep. of Germany ..... 3502619

[51] Int. Cl.[4] ..... F25B 39/02; F28F 1/14

[52] U.S. Cl. ..... 165/150; 165/153; 165/172; 62/526

[58] Field of Search ..... 165/152, 153, 150, 172; 62/515, 526

[56] References Cited

U.S. PATENT DOCUMENTS

| | | | |
|---|---|---|---|
| 337,363 | 3/1886 | Becker | 62/526 |
| 869,577 | 10/1907 | Lacing | 165/150 |
| 1,808,331 | 6/1931 | Wheaton | 62/526 |
| 2,136,641 | 11/1938 | Smith | 165/152 X |
| 3,265,126 | 8/1966 | Donaldson | 165/153 X |
| 4,019,573 | 4/1977 | Modine | 165/153 X |
| 4,159,034 | 6/1979 | Bellovary et al. | 165/153 |
| 4,215,676 | 8/1980 | Gelliam | 165/152 X |

FOREIGN PATENT DOCUMENTS

| | | | |
|---|---|---|---|
| 135358 | 1/1963 | France | 165/152 |
| 2120377 | 11/1983 | United Kingdom | 165/150 |

*Primary Examiner*—Ira S. Lazarus
*Assistant Examiner*—Peggy A. Neils
*Attorney, Agent, or Firm*—Barnes & Thornburg

[57] ABSTRACT

A heat exchanger is described that is constructed of several flat tubes arranged in parallel and at a distance to one another which, at their two front sides, are each closed off tightly. The end areas of the tubes are provided with connecting openings extending transversely to their longitudinal axis and leading to the adjacent flat tube or to the adjacent group of tubes. An advantage of the invention is its ease of manufacture.

4 Claims, 3 Drawing Sheets

Fig. 2
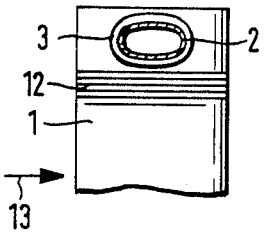
Fig. 5
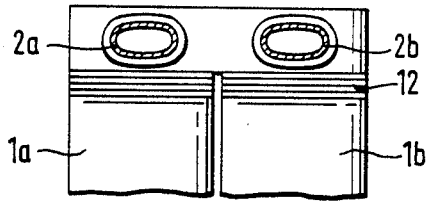
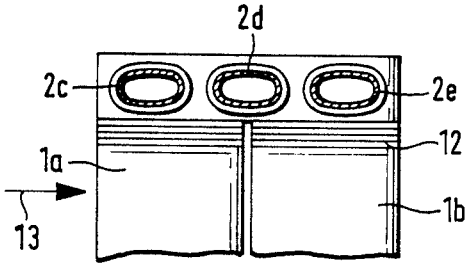
Fig. 6
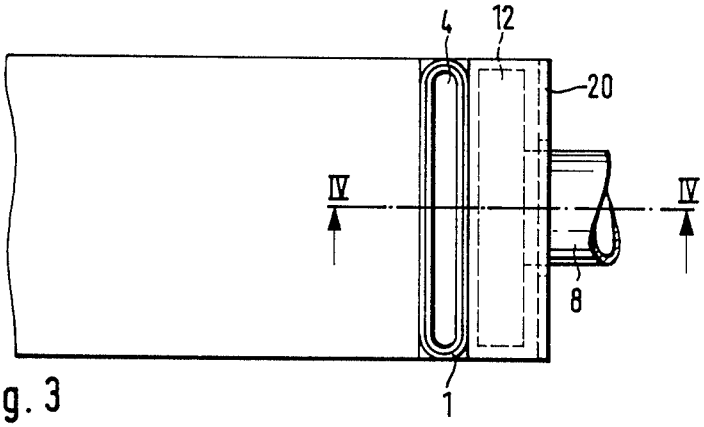
Fig. 3
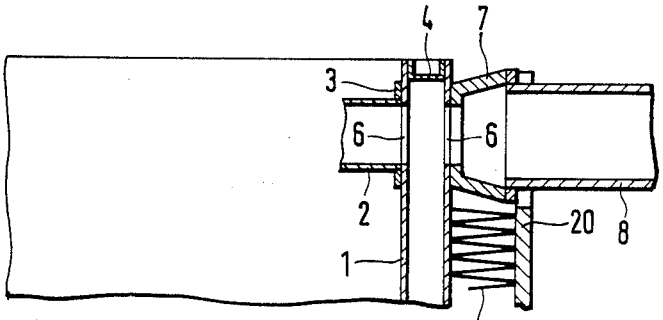
Fig. 4

HEAT EXCHANGER, PARTICULARLY A REFRIGERANT EVAPORATOR

BACKGROUND AND SUMMARY OF THE INVENTION

This invention relates to a heat exchanger, particularly a refrigerant evaporator, comprised of several hollow bodies connected with one another which are arranged parallel to each other but spaced apart from one another, with a plurality of ribs beings inserted between said hollow bodies in order to increase the heat exchange surface.

Heat exchangers of this type are known as tray evaporators. The hollow bodies in tray evaporators generally comprise two flat saucer-type trays whose edges are placed against one another and are tightly soldered together at these edges. This construction has the disadvantage that relatively large surfaces must be soldered together so that the manufacturing expenses, because of the tolerances that must be maintained for the half-shells to be placed together, and also because of the large surface to be soldered, are considerable. In addition, a relatively high proportion of rejects cannot be avoided.

An objective of the present invention is to avoid this disadvantage while providing a heat exchanger that is simpler to produce.

This and other objectives are achieved by the present invention, in a heat exchanger of the initially mentioned type, by providing it with hollow bodies arranged parallel to and separate from one another. A plurality of ribs are disposed between adjacent hollow bodies, and connecting means fluidly connect adjacent hollow bodies. The connecting means include connecting openings which extend transversely in the longitudinal extent of the hollow bodies.

In a preferred embodiment of the present invention, the hollow bodies are flat tubes which have connecting openings extending transversely to their longitudinal extent in both of their end areas.

By the above developments, the hollow bodies no longer have to be soldered over their whole length. A soldering in the area of the connecting openings and possibly at the closed ends is sufficient. Narrow tolerances do not have to be maintained in the manufacturing of such heat exchangers.

Preferred embodiments of simple manufacture are obtained when the ends of the flat tubes are closed by inserted caps. This takes place by a pressing-in and subsequent soldering or by an alternative sealing means according to certain preferred embodiments of the invention. However, the flat tubes can also be closed very easily by a squeezing-together of their free tube ends, and after the free tube ends are squeezed flat, may be sealed by a fold that can be soldered tight in a simple manner according to certain preferred embodiments. The additional fitting of a sealing strip onto the squeezed-together tube ends is also contemplated according to certain preferred embodiments of the invention.

Certain preferred embodiments provide tube sockets which may be inserted tightly into the connecting openings in a simple manner. The tube sockets are preferably provided, for example, with two stop collars so that they may also serve as an assembling aid for the fitting-together of the flat tubes and hold these away from one another. The heat exchange ribs are preferably inserted along with the tube sockets, so that the subsequent soldering process is easy to carry out.

It has proven to be advantageous according to certain preferred embodiments contemplated by the invention to provide the tube sockets with oval cross-sections and have their narrower projected surfaces aligned in the flow-through direction of the heat exchange agent. As a result, the air-flow resistance through the heat exchanger can be reduced.

Finally, in certain preferred embodiments, the connecting openings may also be developed as openings in an expanded part of the tube wall itself, in which case this part of the tube wall is placed directly against a corresponding part of the adjacent tube and is fluidly connected with it, by soldering, for example. For these embodiments, additional tube sockets are not required. The distance between the flat tubes is maintained by means of the expanded part.

Further objects, features, and advantages of the present invention will become more apparent from the following description when taken with the accompanying drawings, which show for purposes of illustration only, an embodiment constructed in accordance with the present invention.

BRIEF DESCRIPTION OF THE DRAWINGS

FIG. 2 is a partial sectional view taken along line II—II in FIG. 1;

FIG. 3 is a partial enlarged top view of the embodiment of FIG. 1 schematically depicting the top end of only one of the hollow bodies;

FIG. 4 is a sectional view taken along line IV—IV in FIG. 3;

FIG. 5 is a view similar to FIG. 2, illustrating another preferred embodiment of the present invention;

FIG. 6 is a view similar to FIG. 5, illustrating a further preferred embodiment of the present invention;

DETAILED DESCRIPTION OF THE DRAWINGS

Figure 1:
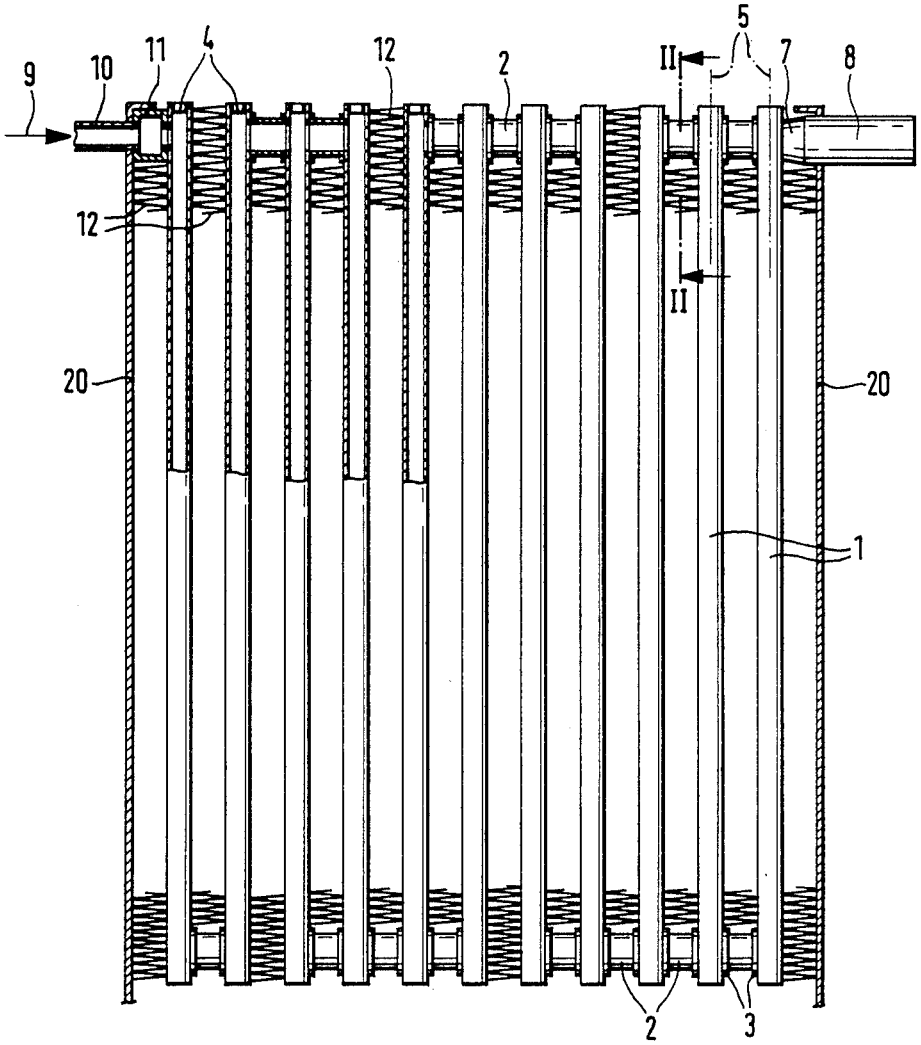
FIG. 1 is a lateral schematic view of a heat exchanger constructed in accordance with a preferred embodiment of the present invention.

FIGS. 1 to 4 show a heat exchanger that is constructed of several flat tubes 1 that are held in spaced parallel relationship to one another. The heat exchanger is intended for use as a refrigerant evaporator, particularly for an air conditioner of a motor vehicle. In the embodiment of FIG. 1, the flat tubes 1 are held at a distance from one another by connecting tube sockets 2, which are inserted between two adjacent flat tubes. Each of the tube sockets 2 are provided with a collar 3 which rests tightly against the assigned flat tube 1.

FIGS. 3 and 4 show that each of the flat tubes 1 has an oval cross-section. At their upper and lower open ends, the flat tubes 1 are closed by caps 4 that are also oval. In these two end areas in which the caps 4 are provided, the flat tubes 1 are also provided with connecting openings 6 extending transversely to the longitudinal axis 5 of the flat tubes 1.

The connecting openings 6 are in alignment with the tube socket 2 or with a connecting sleeve 7 which itself is tightly connected to an outlet joining tube 8 that is used as an outlet for the evaporated refrigerant. The refrigerant flows into the heat exchanger in the direction of arrow 9 through an inlet joining tube 10 that, like the outlet tube 8, penetrates a lateral cover plate 20 and then leads out at a connecting sleeve 11. In turn, the connecting sleeve 11 leads into the top of the first flat tube 1 which on the bottom, via a connecting tube 2, is connected to a second flat tube 1. This second flat tube 1 is part of a first group of two flat tubes through which the coolant flows from the top to the bottom. The refrigerant then flows at the bottom of this first group into two adjacent groups of tubes, which themselves at their top, again lead into the next adjacent group of tubes, etc. In this manner, a zig-zag flow through the individual flat tubes 1 is ensured Between the flat tubes 1 that are separated by means of the connecting sockets 2, are rib bodies 12 of a known construction. These rib bodies 12 are inserted between the flat tubes 1 and, like the connecting sockets 2 and the joining tubes 8 and 9 having connecting sleeves 7 and 11, are connected firmly with the flat tubes or the cover plates 20, by dipping into a soldering bath, for example. Air to be cooled by the evaporator flows through the heat exchange body vertically to the direction of the axes of the connecting tubes 2 in the direction of the arrow 13 of FIG. 2.

FIGS. 5 and 6 show further embodiments which provide for arranging two groups 1*a*, 1*b* of flat tube bodies behind one another in the direction of the air through-flow so that the heat exchange surface can be doubled. As in the embodiment of FIG. 1, the individual flat tubes are connected by connecting tube sockets 2*a*, 2*b* (FIG. 5). Also, wider flat tubes can be placed behind one another and, as shown in FIG. 6, be connected to one another by means of three connecting tube sockets 2*c* to 2*e*. All connecting tube sockets 2, 2*a* to 2*e* have an oval cross-section with the major axis of the cross-section aligned in the direction of the through-flow of air (arrow 13). The air-flow resistance of such connecting tube sockets 2, 2*a*–2*e* is lower than, for example, the air-flow resistance of round connecting tube sockets with the same cross-sectional areas. The placing of additional connecting tube sockets behind one another, because the cross-section presented to the air-flow does not increase, and despite a larger cross-section for refrigerant flow in the tube socket 2, has the advantage of increasing the air-flow resistance only insignificantly. Also, the connection of only one flat tube having wider dimensions by means of two or more connecting tube sockets 2*c* to 2*e* may be advantageous in further embodiments of the present invention.

While in the embodiments illustrated in FIGS. 1 to 4 the ends of the flat tubes 1 are closed by inserted and possibly soldered caps 4, the closing may also be achieved in a different manner.

Figure 7:
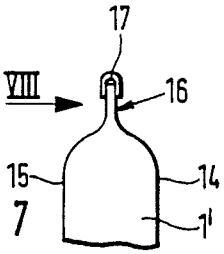
FIG. 7 is a schematic view of a preferred embodiment of a tube end of the present invention.
Figure 8:
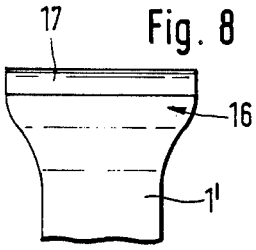
FIG. 8 is a view of the tube end of FIG. 7 in the direction of arrow VIII.

In the preferred embodiment of the present invention shown in FIGS. 7 and 8, the top end of a flat tube 1' is sealed off by flatly and evenly pressing the two side walls 14 and 15 of the flat tube 1' against one another to form a flat flange 16. In the illustrated embodiment, the flat flange 16 is closed off by a U-shaped strip 17 fitted over it which may, for example, be soldered together tightly. In other preferred embodiments, the sealing would also be possible by the formation of a flange 16 which subsequently is folded over once or several times.

Figure 9:
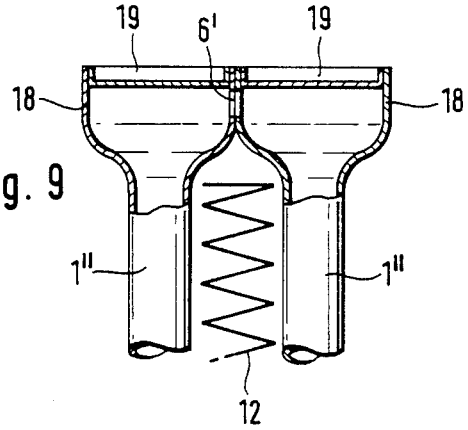
FIG. 9 is a schematic, partially sectional view of a portion of a preferred embodiment of the present invention.
Figure 10:
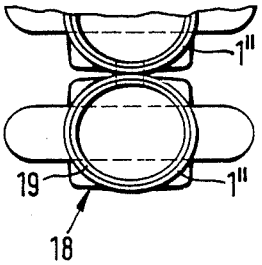
FIG. 10 is a partial top view of the embodiment of FIG. 9.

FIGS. 9 and 10 show a further preferred embodiment which does not include connecting tube sockets 2. The flat tubes 1'', of which only two are illustrated partially, are widened at their two front ends, such that their widened ends 18 rest directly against one another. The connecting openings 6' provided in these widened ends 18 are in alignment. The walls of the widened ends 18 that rest against one another may then be directly soldered together, so that a sealing between the connecting openings 6' is also achieved. The sealing of the upper end in this embodiment is achieved by inserted caps 19. The rib bodies 12 can be inserted between the flat tubes 1'' that rest directly against one another.

The manufacturing of the heat exchangers according to the present invention is very simple. It is sufficient to align the flat tubes directly with one another as shown in FIGS. 9 and 10 and insert the rib bodies 12 into the spaces in-between. The thus aligned components may then, for example, be soldered together in one step. The heat exchange according to FIGS. 1 to 4 can also be manufactured in a similarly simple manner Although the present invention has been described and illustrated in detail, it is to be clearly understood that the same is by way of illustration and example only, and is not to be taken by way of limitation. The spirit and soope of the present invention are to be limited only by the terms of the appended claims.

What is claimed is:

1. A refrigerant evaporator, comprising:

a plurality of adjacent hollow flat tubes arranged parallel to and separate from one another;

a plurality of ribs disposed between said adjacent flat tubes;

inserted caps for sealing both top and bottom ends of said flat tubes; and connecting means for fluidly connecting said adjacent flat tubes, said connecting means including connecting openings in both end areas of each said flat tube, said connecting openings being spaced from the respective top and bottom ends of said flat tubes and opening in opposite directions and extending transversely to the longitudinal extent of said flat tubes to provide a zig-zag flow through said flat tubes, wherein the flat tubes have widened parts of said adjacent flat tubes which are in contact with one another, and wherein said connecting means are openings in said widened parts of said flat tubes.

2. A refrigerant evaporator according to claim 1, wherein said contacting widened parts of adjacent said flat tubes are soldered together.

3. A refrigerant evaporator according to claim 1, wherein said flat tubes have an oval cross-section.

4. A refrigerant evaporator according to claim 2, wherein said flat tubes have an oval cross-section.

* * * * *